US007439848B2

(12) United States Patent
Mantri

(10) Patent No.: US 7,439,848 B2
(45) Date of Patent: Oct. 21, 2008

(54) HANDHELD AID FOR THE VISUALLY IMPAIRED

(76) Inventor: Surag Mantri, 587 Leyte Ter., Sunnyvale, CA (US) 94089

( * ) Notice: Subject to any disclaimer, the term of this patent is extended or adjusted under 35 U.S.C. 154(b) by 48 days.

(21) Appl. No.: 11/248,796

(22) Filed: Oct. 11, 2005

(65) Prior Publication Data

US 2007/0080790 A1 Apr. 12, 2007

(51) Int. Cl.
*G08B 3/10* (2006.01)

(52) U.S. Cl. ..... 340/384.7; 340/573.1; 342/24

(58) Field of Classification Search ..... 340/384.7, 340/573.1, 825.49, 539.11, 985; 342/24; 367/107, 118

See application file for complete search history.

(56) References Cited

U.S. PATENT DOCUMENTS

| | | | | |
|---|---|---|---|---|
| 3,172,075 | A | 3/1965 | Kay | 340/1 |
| 3,366,922 | A | 1/1968 | Kay | 340/1 |
| 3,907,434 | A * | 9/1975 | Coles | 356/141.4 |
| 4,080,517 | A | 3/1978 | Moricca | 179/99 |
| 4,660,022 | A * | 4/1987 | Osaka | 340/384.3 |
| 4,712,003 | A | 12/1987 | Ban | 250/221 |
| 5,487,669 | A * | 1/1996 | Kelk | 434/112 |
| 6,094,158 | A | 7/2000 | Williams | 342/70 |
| 6,298,010 | B1 * | 10/2001 | Ritz et al. | 367/116 |
| 6,470,264 | B2 | 10/2002 | Bide | 701/207 |
| 6,489,605 | B1 * | 12/2002 | Ritz et al. | 250/221 |
| 2002/0011951 | A1 * | 1/2002 | Pepin et al. | 342/357.13 |
| 2002/0067271 | A1 * | 6/2002 | Depta | 340/573.1 |
| 2005/0099318 | A1 * | 5/2005 | Gilfix et al. | 340/825.19 |

FOREIGN PATENT DOCUMENTS

| | | |
|---|---|---|
| FR | 2562679 | 2/1984 |

* cited by examiner

*Primary Examiner*—Phung T. Nguyen
(74) *Attorney, Agent, or Firm*—Jeffrey Schox

(57) ABSTRACT

The system of the preferred embodiments includes a housing, an input element to detect the characteristics of an area, a processor to convert the detected characteristics of an area to an output signal, and an aiming device to adjust the orientation of the input element with respect to the housing. The system has been designed to detect the characteristics of an area and convert the detected characteristics to an output signal to a visually impaired user.

20 Claims, 3 Drawing Sheets

HANDHELD AID FOR THE VISUALLY IMPAIRED

TECHNICAL FIELD

This invention relates generally to the field of vision aids, and more specifically to a handheld system for aiding a visually impaired user.

BACKGROUND

Over one million people in the United States and over forty-two million people worldwide are legally blind. Even more people suffer from low or reduced vision. For this large population, simple daily tasks such as traveling, leaving the house to attend social events, or simply running errands, can be quite daunting tasks. The vision aids that have been developed in the past are large and bulky, and have drawn attention to the fact that the user had an impairment. Thus, there is a need in the art of vision aids for a new and useful handheld system that avoids or minimizes the disadvantages of past vision aids. This invention provides such a new and useful handheld aid.

DESCRIPTION OF THE PREFERRED EMBODIMENTS

The following description of the preferred embodiments of the invention is not intended to limit the invention to these preferred embodiments, but rather to enable any person skilled in the art to make and use this invention.

Figure 1A:
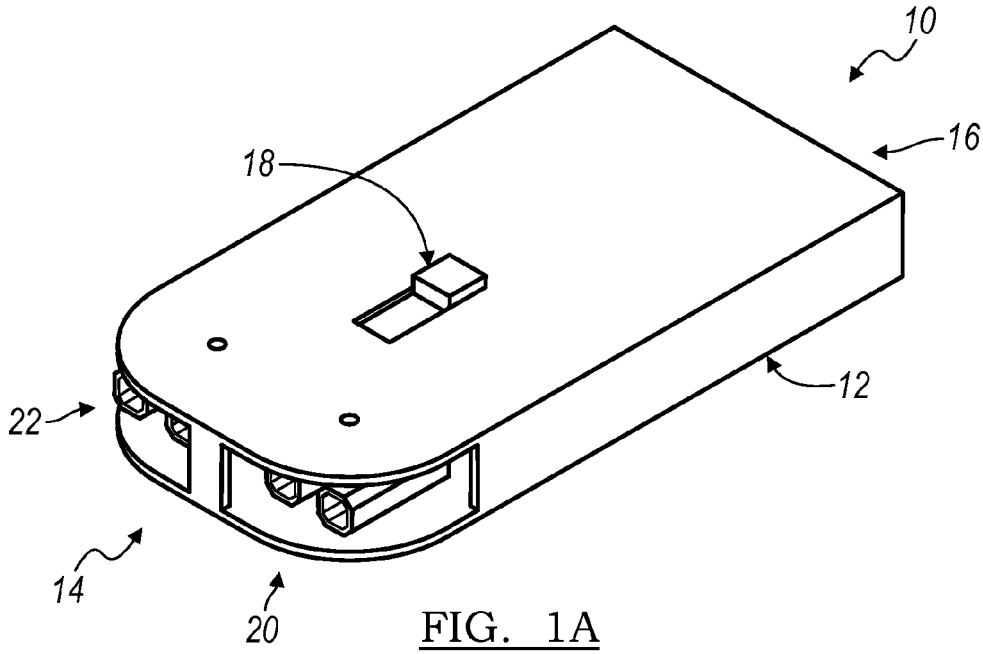
FIGS. 1A, 1B, and 1C are representations of the first embodiment of the handheld system, the first variation of the housing, the first variation of the input device, and the first variation of the aiming device.
Figure 1B:
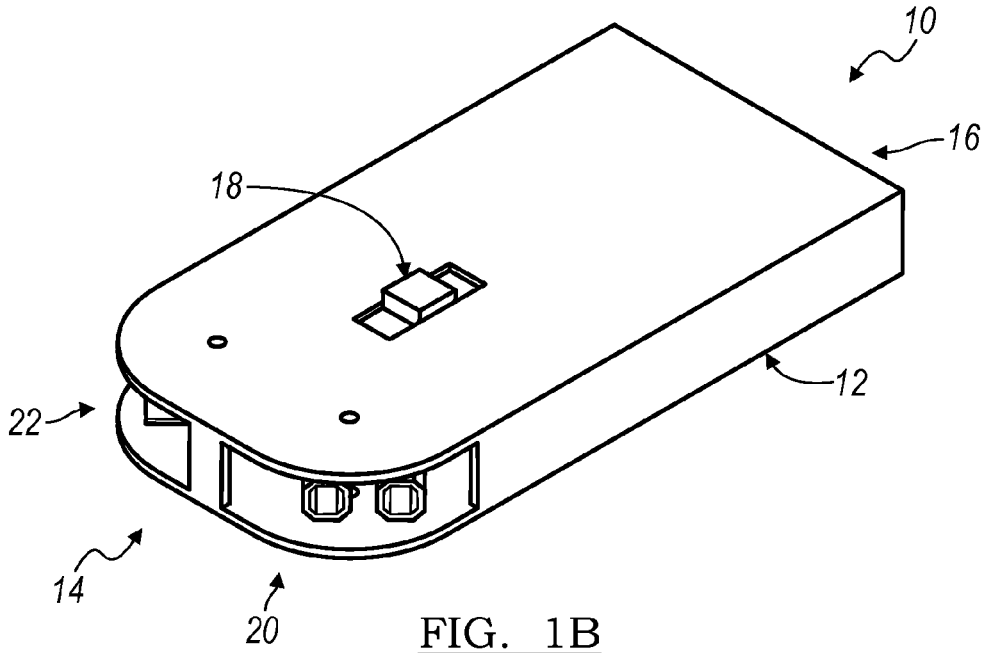
Figure 1C:
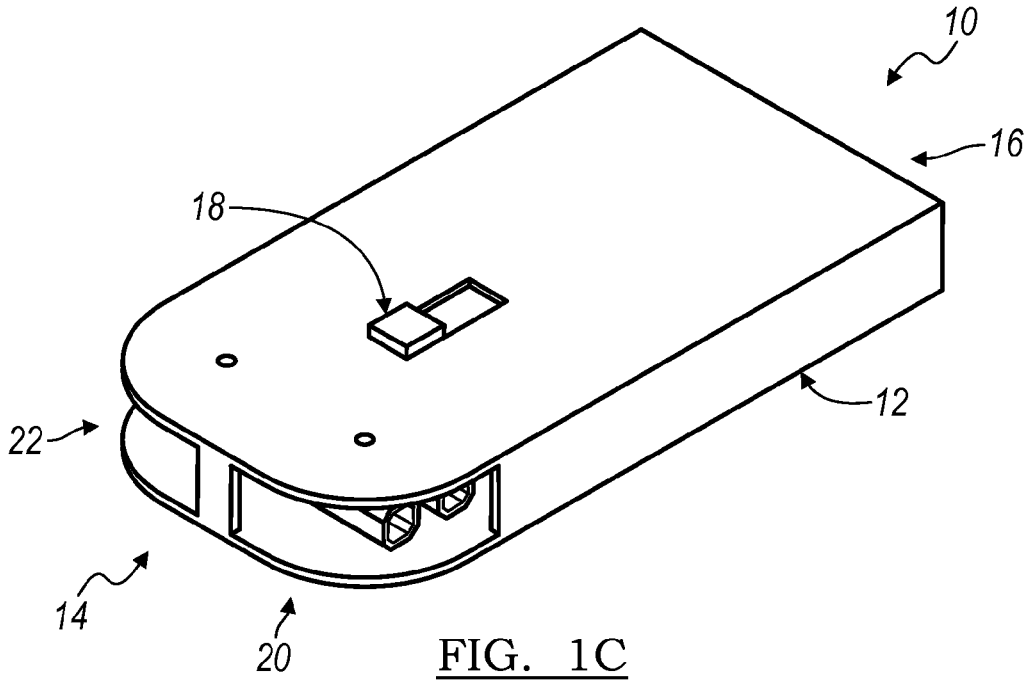

As shown in FIGS. 1A, 1B, and 1C, the system 10 of the preferred embodiments includes a housing 12, an input element 14 to detect the characteristics of an area, a processor 16 to convert the detected characteristics of an area to an output signal, and an aiming device 18 connected to the housing 12 and adapted to adjust the orientation of the input element 14 with respect to the housing 12. This invention has been specifically designed to detect the characteristics of an area and convert the detected characteristics to an output signal thereby allowing the user to "see" the area around them through a virtually replicated environment created by the system 10. The system 10 has further been specifically designed to be small and relatively inconspicuous so that the visually impaired user may use the system 10 without calling attention to their impairment. The system 10, however, may be alternatively used in any suitable environment and for any suitable reason.

Figure 2:
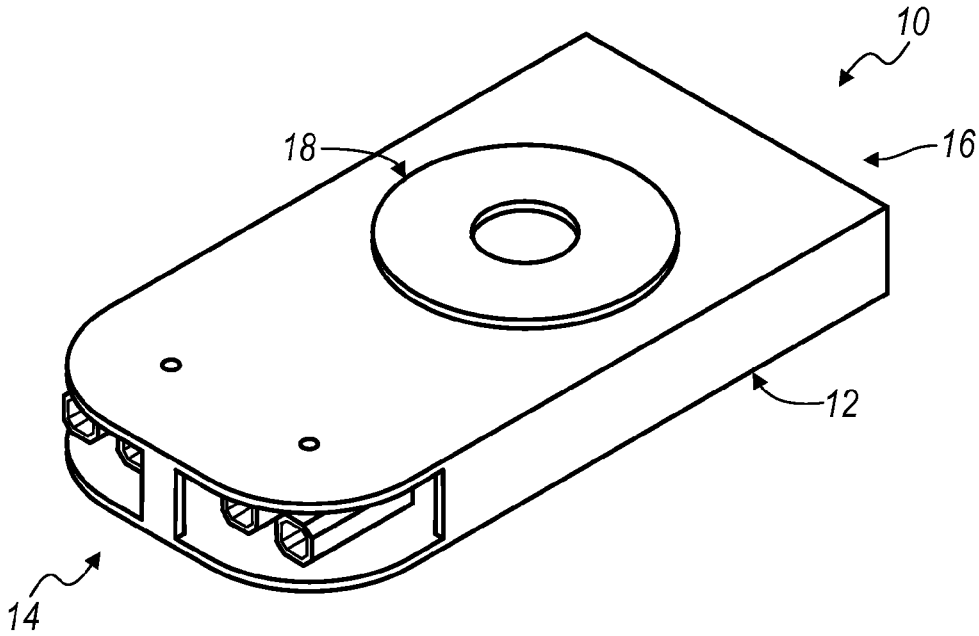
FIG. 2 is a representation of the second variation of the housing, adapted to resemble an Apple iPod Nano (2005), and the second variation of the aiming device.

The housing 12 of the preferred embodiments functions to enclose the elements of the system 10 and to be held in the hand of the user. The housing 12 is preferably one of several variations. In the first variation, the housing 12 is a standard housing case preferably made of a plastic or metal, but alternatively may be made of any suitable material. In the second variation, as shown in FIG. 2, the housing 12 is adapted to resemble a handheld Apple iPod Nano (2005). This variation is preferably made of white plastic front with a metallic back, but alternatively may be made of any suitable material to resemble a handheld Apple iPod Nano (2005) design. The benefit of this variation is that it will appear that the user is simply using a handheld music playing device rather than a visual aid. In a third variation, the housing 12 is adapted to resemble an accessory such as a watch. The housing 12 may be further adapted to resemble a bracelet, belt, patch, band, pager, mobile phone, necklace, or any other suitable accessory or element that disguises the function of the system 10. Although the housing 12 is preferably one of these three variations, the housing 12 may be any suitable housing or case to enclose the elements of the system 10.

The input element 14 of the preferred embodiments, which is connected to the housing 12, functions to detect the characteristics of an area. The input element 14 may comprise a single sensor or alternatively may comprise a left sensor 20 and a right sensor 22, as shown in FIGS. 1A, 1B, and 1C. The left sensor 20 and right sensor 22 may be adapted to be independently adjustable. In the first variation, the input element 14 is adapted to detect infrared light. In this variation, the input element 14 is preferably a standard infrared sensor, but may alternatively be any suitable device adapted to detect infrared light. In this first variation, the system 10 is further adapted to comprise a filter element. The filter element, which is coupled to the input element 14, functions to reduce the noise caused by solar radiation and detected by the input element 14. The filter element is preferably a digital filter or a film-like filter, but may alternatively be any suitable device to provide additional signal processing and filtration of solar radiation. In further variations, the input element 14 may alternatively comprise any suitable hardware, software, or optical sensor to detect the characteristics of an area such as ultrasound sensors or laser radiation sensors.

The processor 16 of the preferred embodiments which is coupled to the input element 14, functions to convert the characteristics of the area detected by the input element 14 to an output signal. The processor 16 preferably converts the detected characteristics to an output signal where one or more of a frequency, an amplitude, a pitch, and a timing of the output signal is representative of the characteristics of the area detected by the input element 14. For example, objects that are detected to be closer will elicit a different output signal from those objects that are detected to be further away. The output signal is preferably one of several variations. In the first variation, the output signal is an audio signal. In the second variation, the output signal is a haptic signal, such as vibration or moving Braille-like needles. In the third and fourth variation, the output signal is recognized as a taste signal or smell signal, respectively. Although the output signal is preferably one of these four variations, the output signal may be any suitable signal to which the processor 16 can convert the detected characteristics of the area and are thus representative of the area.

The processor 16 may further function to associate a prerecorded output signal to a particular characteristic. For this function, the processor 16 further includes a memory element that functions to store information. The memory element accepts and stores a prerecorded output signal from the user. The processor 16, associating the prerecorded output signal to a particular characteristic, outputs the prerecorded output signal upon detection of the particular characteristic. The processor 16 may further function to determine when the input element 14 is detecting a redundant characteristic. Upon detecting such a redundant characteristic, the processor 16 preferably converts this characteristic to a different output signal, such as a muted output signal. Additionally, the processor 16 may be adapted to have a feedback-at-will setting, or may be configured or calibrated to the user's liking. In the feedback-at-will setting, the user may determine when the processor 16 converts the determined characteristics to an output signal rather than the processor 16 continuously converting characteristic detections to output signals (the default setting). The processor 16 is preferably a conventional processor, but may alternatively be any suitable device to perform the desired functions.

Figure 4:
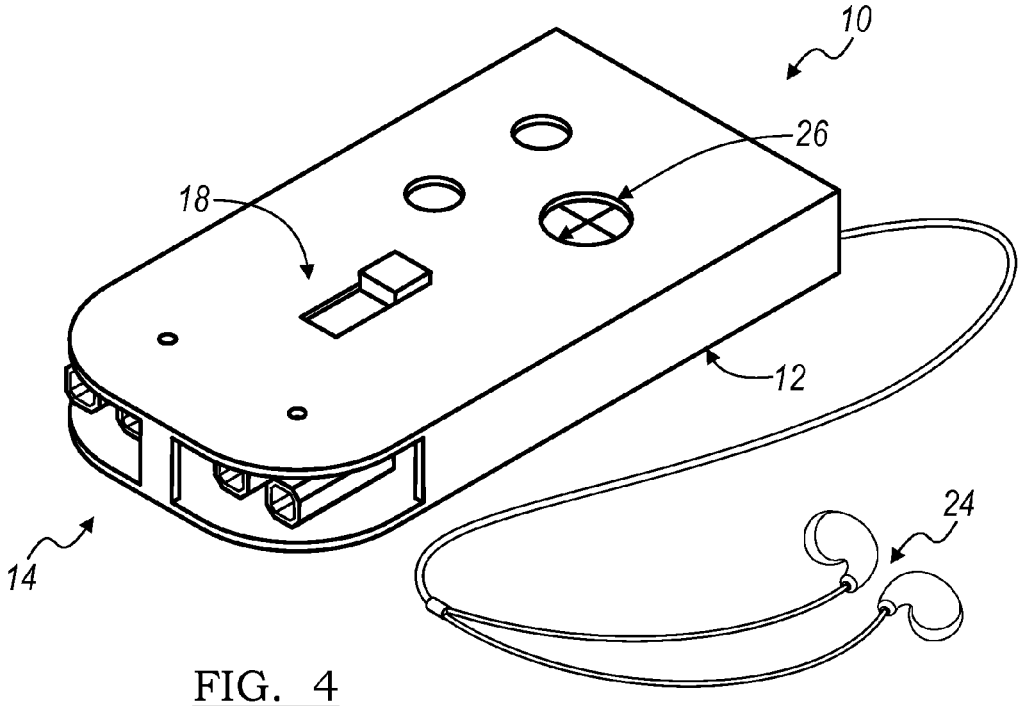
FIG. 4 is a representation of the first variation of the output element with a compass.

The system 10 may further include an output element 24 that functions to transmit the output signal. The output element 24 is preferably one of several variations. In the first variation, the output element 24 is an aural feedback element and is adapted to transmit an audio signal. The output element 24 in this variation, as shown in FIG. 4, may be standard headphones or ear buds, but may alternatively be any suitable device adapted to transmit an audio signal to the user. In the second variation, the output element 24 is a haptic feedback element adapted to transmit a haptic signal, such as vibration or moving Braille-like needles. The output element 24 in this variation is preferably within the housing 12 and held or worn by the user, but may alternatively be any suitable device adapted to transmit a haptic signal to the user. In the third and fourth variation, the output element 24 is a device adapted to transmit a taste signal or smell signal, respectively. Although the output signal is preferably one of these four variations, the output element 24 may be any suitable device adapted to transmit the output signal to the user.

The processor 16 may further function to convert the detected characteristics to a stereoscopic output signal to the output element 24 based on the orientation of the input element 14. For example, when the characteristics of the area are detected by the left sensor 20 of the input element 14, the processor 16 converts the detected characteristic to a left output signal. Similarly, if the characteristics of the area are detected by the right sensor 22 of the input element 14, the processor 16 converts them to a right output signal. If the input element 14 comprises only a single sensor, the output signal is transmitted by the output element 24 to the left side of the user when the sensor is oriented to the left (negative 90 degrees), and to the right side of the user when the sensor is oriented to the right (positive 90 degrees) with respect to the housing 12. When the sensor is oriented between negative and positive 90 degrees, the output signal is transmitted by the output element 24 to an appropriate combination of both the left and right side of the user.

The aiming device 18 of the preferred embodiments, which is connected to the housing 12, functions to adjust the orientation of the input element 14 with respect to the housing 12 based on a subtle input from the user. The subtle input is a vast improvement over past visual aids that require the user to sway or move the entire device to scan the surrounding area. Further, the user can rotate the housing 12 in their hand from a flat position (where they can visualize left and right of the user) to a perpendicular position where they can visualize above and below the user.

The aiming device 18 is preferably one of several variations. In the first variation, as shown in FIGS. 1A, 1B, and 1C, the aiming device 18 is a linear finger switch. In this variation, the aiming device 18 accepts a subtle, linear finger movement from the user. Based on the user input, the aiming device 18 adjusts the orientation of the input element 14 with respect to the housing 12. As shown in FIG. 1A, the input element 14 comprises a left sensor 20 and a right sensor 22. The aiming device 18 is in the full back position and the sensors are in a center orientation. As shown in FIG. 1B, as the user slides the aiming device 18 to the middle position with a subtle finger movement, the aiming device 18 simultaneously adjusts the orientation of the left sensor 20 from the center orientation towards a left orientation and the right sensor 22 from a center orientation towards a right orientation. In FIG. 1C, the aiming device 18 is in the full forward position and has simultaneously adjusted the left sensor 20 to a full left position and the right sensor 22 to a full right position.

In the second variation, as shown in FIG. 2, the aiming device 18 is designed to resemble the touch wheel of an Apple iPod Nano (2005). The aiming device in this variation accepts a subtle user input in the form of an arcuate finger movement. Based on this finger movement, the aiming device 18 adjusts the orientation of the input element 14 with respect to the housing 12. The aiming device 18 in this variation is adapted to adjust the orientation of the input element 14 from a center orientation to a left (negative 90 degree) orientation based on an arcuate finger movement in the counter-clockwise direction. Similarly, the aiming device 18 is adapted to adjust the orientation of the input element 14 from a center orientation to a right (positive 90 degree) orientation based on an arcuate finger movement in the clockwise direction.

Figure 3:
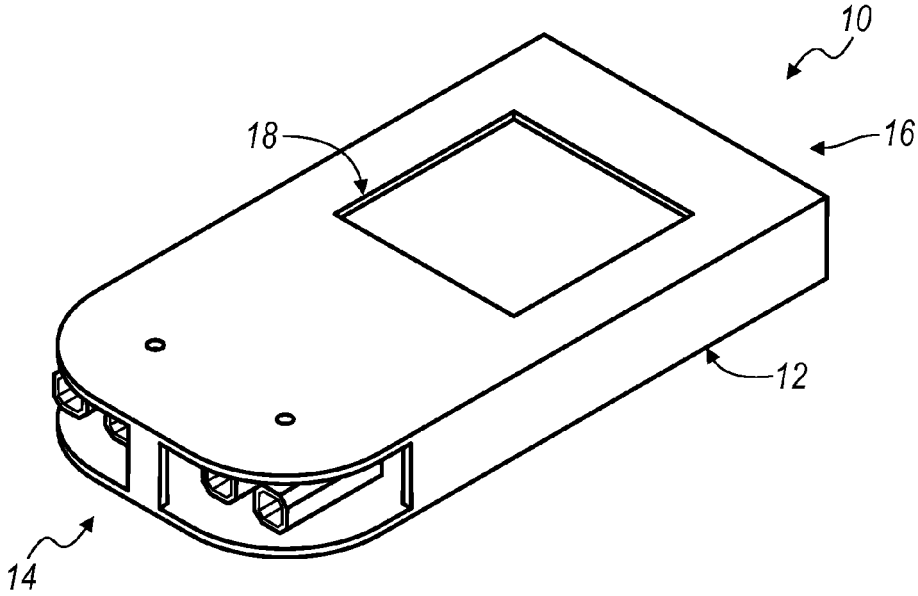
FIG. 3 is a representation of the third variation of the aiming device.

In a third variation, as shown in FIG. 3, the aiming device 18 is a touch pad. The aiming device 18 in this variation adjusts the orientation of the input element 14 based on the user's subtle finger movements on the pad. For example, a subtle finger movement to the left orients the input element 14 towards the left (negative 90 degrees) and a subtle finger movement to the right orients the input element 14 towards the right (positive 90 degrees) with respect to the housing 12.

Although the aiming device 18 is preferably one of these three variations, the aiming device 18 may be any suitable device adapted to adjust the orientation of the input element 14 with respect to the housing 12. In addition, the aiming device 18 may be further adapted to have an auto-scanning function and/or an auto-centering function. While operating in auto-scanning mode, the aiming device 18 selectively adjusts the orientation of the input element 14 with respect to the housing 12 in an automatic, and preferably cyclic, manner. For the auto-scanning function, the aiming device 18 further includes a propulsion element adapted to adjust the orientation of the input element 14 with respect to the housing 12 while operating in auto-scanning mode. The propulsion element is preferably a conventional motor, but may alternatively be any suitable device or method. For the auto-centering function, the aiming device 18 further includes an auto-centering device adapted to center the orientation of the input element 14 with respect to the housing 12. The auto-centering function may be initialized by the user (by a button or other suitable device or method), or may be automatically initiated by the processor 16.

The system 10 of the preferred embodiment may also include a wireless device. The wireless device is adapted to connect the input element 14, processor 16, aiming device 18, or output element 24 if any of these elements are separate and not enclosed by the housing 12. The wireless device may also be adapted to connect the system 10 to another adjacent system 10, or may function to connect the system 10 to a larger network, such as a ZigBee network, a Bluetooth network, or an Internet-protocol based network. In one variation, the processor 16 transmits a radio frequency (RF) signal and a receiver in the output element 24 receives the RF signal. In a second variation, the processor 16 transmits a signal over a network (possibly a wireless local access network or the internet using an internet protocol address) and a receiver in the output element 24 receives the signal. In a third variation, the output element 24 is connected to the system 10 and the output signal is transmitted through a Bluetooth network to the output element 24 and to the user.

The system 10 of the preferred embodiment may also include additional features such as a compass 26, a pedometer, and an ambient condition detector device. The compass 26, as shown in FIG. 4, is connected to the housing 12 and functions to detect the direction of the system 10. The processor 16 is further coupled to the compass 26 and is further adapted to convert the detected direction to an output signal. The compass is preferably a digital compass to provide real time feedback of the user's current direction, or to navigate the user in the desired direction, but may alternatively be any suitable direction detecting device. The processor is preferably adapted to selectively operate in the following three modes: detected characteristics of an area, detected direction of the system, and user defined direction.

The pedometer, which is connected to the housing 12, functions to detect the distance traveled by the user and count the number of steps taken. The processor 16 is further coupled to the pedometer and is further adapted to convert the detected distance traveled to an output signal. The ambient condition detector, which is connected to the housing 12, functions to detect the ambient conditions of the area such as time, temperature, pressure, or humidity. The processor 16 is further coupled to the ambient condition detector and is further adapted to convert the detected ambient conditions to an output signal.

Although omitted for conciseness, the preferred embodiments include every combination and permutation of the various housings, input elements, processors, and aiming devices.

As a person skilled in the art will recognize from the previous detailed description and from the figures and claims, modifications and changes can be made to the preferred embodiments of the invention without departing from the scope of this invention defined in the following claims.

I claim:

1. A handheld system for aiding a visually impaired user, comprising:

a housing;

an input element connected to the housing and adapted to detect characteristics of an area;

a processor coupled to the input element and adapted to convert the detected characteristics to an output signal; and an aiming device connected to the housing and adapted to adjust the orientation of the input element with respect to the housing.

2. The system of claim 1 wherein the input element is adapted to detect light.

3. The system of claim 2 further comprising a filter device coupled to the input element and adapted to reduce the detection of noise caused by solar radiation.

4. The system of claim 1 wherein the processor is further adapted to convert detected characteristics to an output signal where one or more of a frequency, an amplitude, a pitch, and a timing of the output signal is representative of the detected characteristics.

5. The system of claim 4 wherein the output signal is an audio signal.

6. The system of claim 5 wherein the processor is further adapted to convert the detected characteristics to a stereoscopic audio signal.

7. The system of claim 1 wherein the processor further comprises a memory element adapted to store information.

8. The system of claim 7 wherein the memory element is adapted to accept and store a prerecorded output signal from the user, wherein the processor is adapted to associate the prerecorded output signal to a particular characteristic and to output the prerecorded output signal upon the detection of the particular characteristic.

9. The system of claim 1 wherein the processor is further adapted to determine when the input element is detecting a redundant characteristic and to convert redundant characteristics to an alternative output signal.

10. The system of claim 1 wherein the aiming device is further adapted to accept a subtle user input in the form of a linear finger movement and, based on the user input, adjust the orientation of the input element with respect to the housing.

11. The system of claim 10 wherein the input element includes a left sensor and a right sensor, and wherein the aiming device is adapted to simultaneously adjust the orientation of the left sensor from a center orientation to a left orientation and the right sensor from a center orientation to a right orientation based on the subtle user input.

12. The system of claim 1 wherein the aiming device is further adapted to accept a subtle user input in the form of an arcuate finger movement and, based on the user input, adjust the orientation of the input element with respect to the housing.

13. The system of claim 12 wherein the aiming device is adapted to adjust the orientation of the input element from a center orientation to a right orientation based on an arcuate finger movement in a clockwise direction.

14. The system of claim 13 wherein the processor is further adapted to convert detected characteristics to a stereoscopic output signal based on the orientation of the input element.

15. The system of claim 13 wherein the aiming device further comprises an auto-centering device adapted to center the orientation of the input element with respect to the housing.

16. The system of claim 1 wherein the aiming device is further adapted to selectively adjust the orientation of the input element in an automatic manner.

17. The system of claim 1 further comprising an output element coupled to the processor and adapted to transmit the output signal.

18. The system of claim 17 wherein the output element comprises an aural feedback element.

19. The system of claim 1 further comprising a compass coupled to the housing and adapted to detect direction of the system, wherein the processor is further coupled to the compass and is further adapted to selectively convert the detected direction to an output signal.

20. The system of claim 1 wherein the processor is adapted to selectively operate in the following three modes: detected characteristics of an area, detected direction of the system, and user defined direction.

* * * * *